US005094259A

United States Patent [19]

Hsu

[11] Patent Number: 5,094,259

[45] Date of Patent: Mar. 10, 1992

[54] AUTOMATIC SHUT-OFF SAFETY DEVICE FOR GAS STOVE

[76] Inventor: Chung-Hsiung Hsu, No. 233, Chung-Hua Road, Hsin-Wu Hsiang, Tao-Uuan Hsien, Taiwan

[21] Appl. No.: 521,558

[22] Filed: May 10, 1990

[51] Int. Cl.[5] ..... F23D 14/72

[52] U.S. Cl. ..... 137/66; 137/614.11; 251/111

[58] Field of Search ..... 137/65, 66, 624.11, 137/624.12, 624.22, 614.11; 431/78, 79, 80; 251/111

[56] References Cited

U.S. PATENT DOCUMENTS

| | | | |
|---|---|---|---|
| 2,715,437 | 8/1955 | Drow | 137/65 X |
| 3,392,740 | 7/1968 | Fleer | 137/65 |
| 3,595,273 | 7/1971 | Kolodziej | 137/624.12 |
| 3,820,405 | 6/1974 | Hong | 137/624.22 X |
| 4,755,133 | 7/1988 | Geary | 431/78 X |

*Primary Examiner*—Stephen M. Hepperle
*Attorney, Agent, or Firm*—Larson and Taylor

[57] ABSTRACT

An automatic shut-off device for a gas stove, and more particularly, a safety valve control device that can be retrofitted between the gas inlet pipe and the catch base of the stove. The device includes a coupling such that operation of the knob of the gas stove at the time operates the circuit of a gas safety valve control device. This operation causes the forward movement of a function shaft of the gas safety valve device and opens the gas intake valve to supply the gas to the stove burner. The function shaft is also subject to the control by an electromagnetic control rod to maintain the open state of the gas intake valve. In case the fire goes out accidently, the circuit device energizes an electromagnetic coil to attract upwardly an electromagnetic control rod, thereby disconnecting the function shaft, which is spring loaded, and which in turn operates the gas intake valve. This action thus disconnects the gas supply to the stove. Also, if the cooking time is too long, and the fire does not go out (e.g., one forgets to turn off the gas) or the gas at the stove burner can not be ignited within the given time, the device will also shut off automatically the gas intake valve.

1 Claim, 7 Drawing Sheets

AUTOMATIC SHUT-OFF SAFETY DEVICE FOR GAS STOVE

BACKGROUND OF THE INVENTION

1. Field of the Invention

The present invention generally relates to a new safer and more practical automatic shut-off device for a gas stove. More particularly, the present invention relates to a gas safety valve control device fitted between the gas intake pipe and the catch base.

2. Description of the Prior Art

The gas stove is the most popular cooking appliance used by ordinary families, and it brings a greater convenience for housewives in cooking. However, most gas stoves are not equipped with proper, attached safety devices. The casual negligence in use—such as going out without shutting off the gas stove, the fire is extinguished by wind without any notice, or the first is extinguished by water or food liquid boiling over and so on—often causes gas poisoning and sometimes even an explosion. This mishaps bring not only expensive property losses, but also endangers lives.

The traditional gas stoves have these defects as mentioned previously. We came to learn after conducting a study that some businessmen continuously put those gas stoves having safety devices on sale in order to provide more safety in the use of gas stoves. It was found that there was one type that uses an electromagnetic valve to control a snail-shaped spring so as to restore the rotary shaft of the gas switch, thereby initiating the control device to shut off the gas switch valve. A second type utilizes an integrated circuit to control the rotation of a motor to achieve the effect of opening and shutting the gas valve. The businessmen advertise the effectiveness of the automatic shut-off of the gas to control boiling over. Theoretically, it seems workable, but it really has many flaws. The reasons generally are as follows.

1. The automatic gas shut-off device is generally using the motor to drive the gear or using the snail-shaped spring to drive the gear for turning the gas switch's rotary shaft and shutting off the gas valve. Therefore, the members are complicated and the manufacturing cost is not only expensive, but the rate of break-down is also very high, making maintenance quite difficult.
2. The power transmission parts of these automatic shut-off devices for gas stoves include a modular unit comprised of a motor, a snail-shaped spring and driving gear members and the elements in between the gas valve body, which must be closely mated or interrelatedly engaged. Thus the members that cannot be replaced or repaired must be replaced in packages, which the dealers cannot afford to do.

3. The ignition circuit of the gas stove and the control circuit are closely interrelated. When defects develop or there is a power supply failure, they become paralyzed and useless. So it is not convenient, not ideal and not practical to use.

Thus there is a need for a fool-proof device for gas stoves. However, the earlier gas stove's automatic safety device had many defects and limitations in practical use.

SUMMARY OF THE INVENTION

After many years study and repeated tests, we developed this improved, safer and more practical new automatic safety shut-off device for gas stove.

The object of this invention is to provide an automatic safety shut-off device for a gas stove having a "safety valve control device." The safety valve device maintains a closed state under normal conditions. When the hand-pressed rotary knob switch is turned on in each operation, which is similar to the turning-on and ignition steps of an ordinary gas stove, the safety valve control device of the gas stove will be switched on to supply the gas to the stove head, or burner, for burning. This will also energize the power sources of the circuit device. Should the stove fire go out, the instantaneous magnetic excitation of the electromagnetic coil will be sufficient to attract the upward action of the electromagnetic control rod to disconnect the function axis with the aid of the operation of the circuit device. A function shaft will repeat the shut-off of the gas intake valve operation by means of the elasticity of a valve spring, stopping the gas transmission to the stove head and completing the automatic safety shut-off of the gas. The turn-on and shut-off operation is absolutely fool-proof and does not have any flaws or bad phenomenons.

A second object of the present invention is to provide a safety automatic device for a gas stove that is a valve control type of device that can be retrofitted on an existing stove. The device can be mounted on the gas intake catch base of the gas valve body without the original set-up and operation of the gas stove undergoing any change. This device is applicable to all stoves and it does not matter whether they are old or new gas stoves. In addition to saving the development cost and investment, they are easily compatible, and applicable to gas stoves of any brand.

In operation, when the switch knob of the gas stove is pressed to the left at the time of ignition, the device of the present invention will simultaneously start the gas safety valve. In case the fire goes out accidently, the cooking time is too long or the ignition is not possible within a predetermined period of time, the device will function to shut off automatically the intake valve using the circuit in the gas safety valve.

DETAILED DESCRIPTION OF THE PREFERRED EMBODIMENTS

Figure 1:
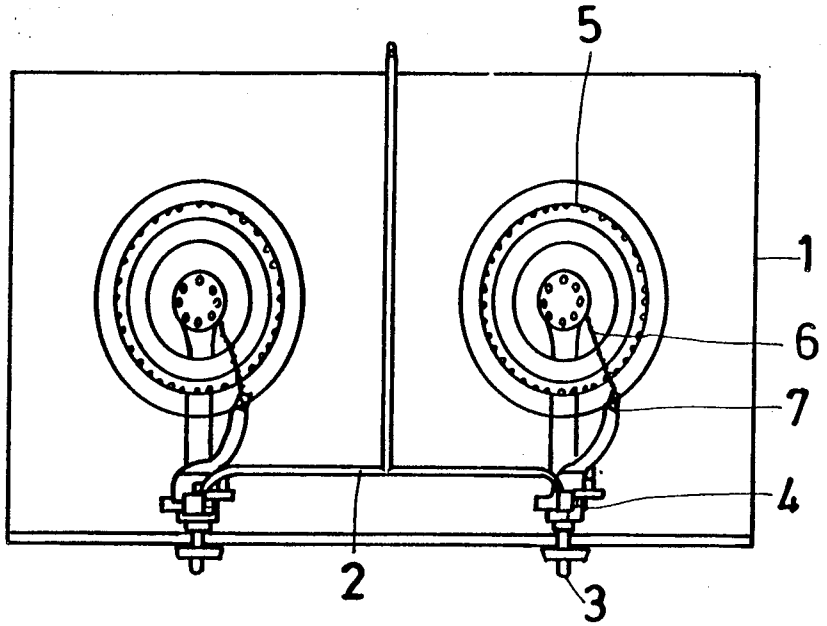
FIG. 1 is a plan view of a gas stove.
Figure 2:
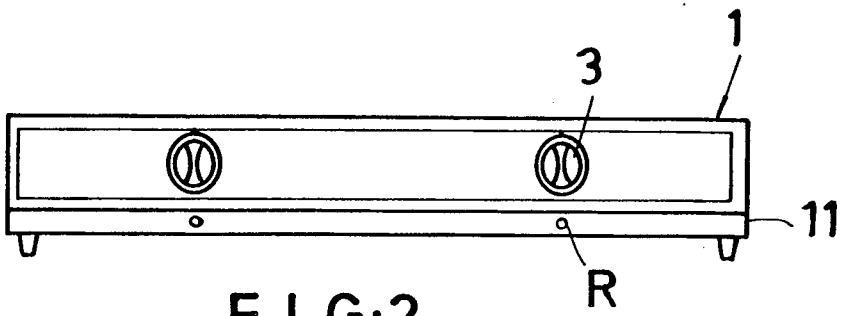
FIG. 2 is a front elevational view of the gas stove.
Figure 3:
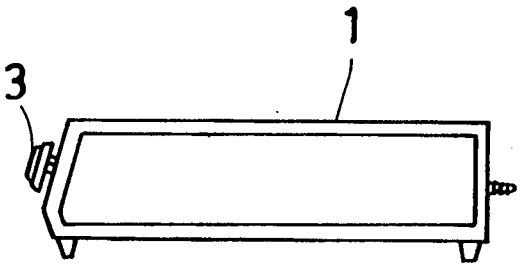
FIG. 3 is a side elevational view of the gas stove.

FIGS. 1, 4, 5 and 10 illustrate a conventional gas stove 1 which receives a gas supply from a gas intake pipe 2 and a valve body 8 of the gas stove 1, which has a gas intake catch base 81. Located in between pipe 2 and catch base 81 is a safety control device 4 comprised of a gas safety valve device 9 and an electric circuit 10. Stove 1 has a stove burner or head 5, near which there is fixedly mounted a spark detector 6, which is in addition to the original ignition device to control the circuit device 10 through electricity. Device 4 is principally fitted on catch base 81 of the gas intake of gas stove valve body 8. However circuit 10 of the present invention is mounted under the gas stove valve body 8. Alternatively, circuit 10 can be mounted at a suitable location for convenient assembling and disassembling at any time. In addition, a printed circuit base plate 12 (FIG. 5) is mounted to the housing of circuit device 10 and contains a micro-activated switch LS and a pilot lamp R. Lamp R is visible on the outer part of panel 11 of the gas stove (as shown in FIG. 2) for facilitating external observation by the key cooking personnel to determine externally whether circuit device 10 of the present invention is starting operation or is experiencing a power failure.

Figure 5:
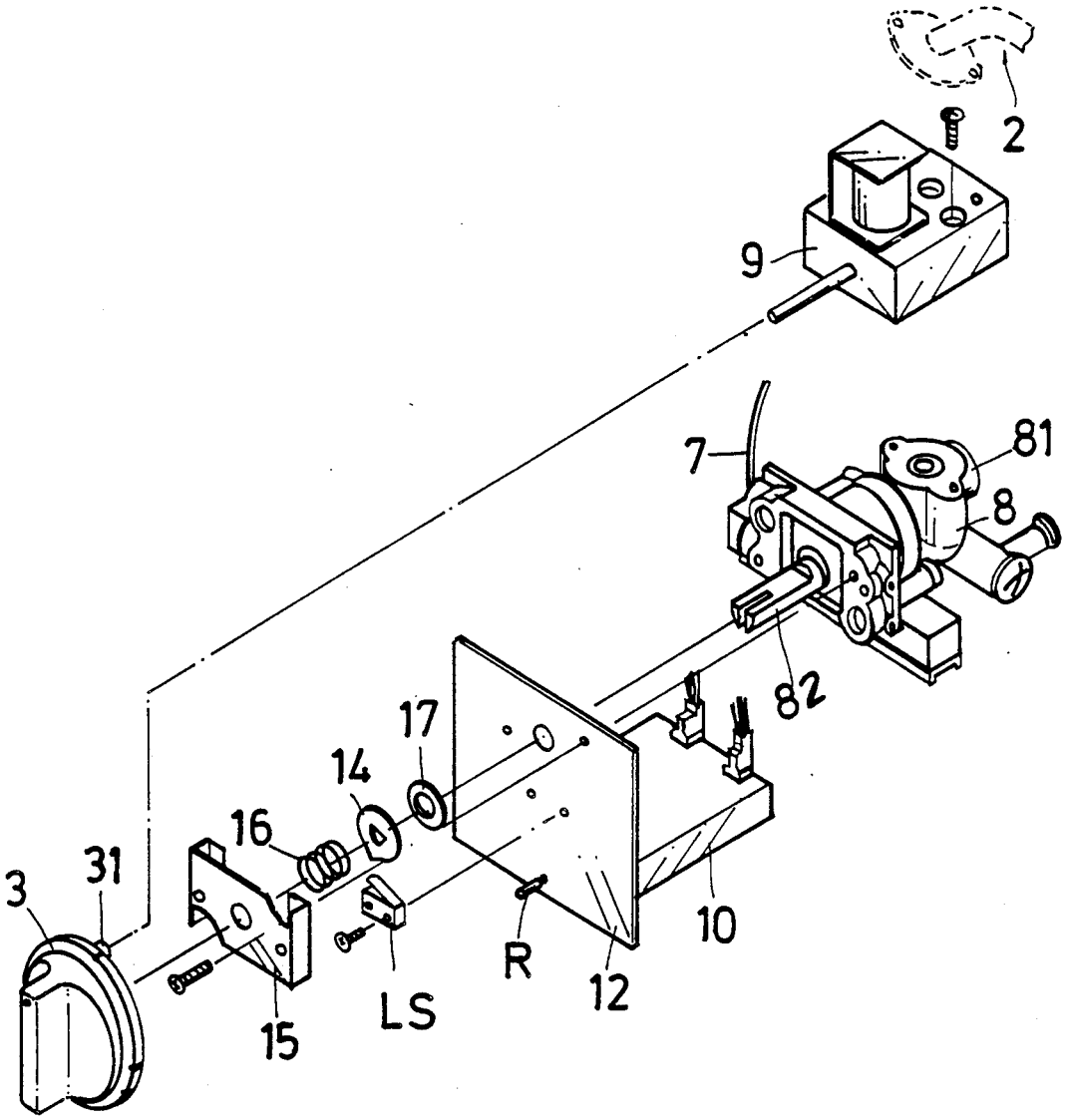
FIG. 5 is an exploded perspective view of the gas safety valve device and the conventional gas (stove) valve body.

As depicted in FIG. 5, there is a cam 14 mounted on the gas switch rotary knob shaft 82. Shaft 82 can drive cam 14 when the gas stove's switch rotary knob 3 is manually positioned by the user of the stove at the time of ignition. Cam 14 is used to position the micro-activated switch LS and light the pilot lamp R, bringing the circuit device 10 into operation. In order to keep cam 14 of the present invention operating smoothly and always maintaining contact with micro-activated switch LS, there is a coil spring 16 and one washer 17 positioned respectively in front and in back of cam 14 on gas switch rotary knob shaft 82. A protecting hood cover 15 is used to limit the rotation of cam 14.

Figure 4:
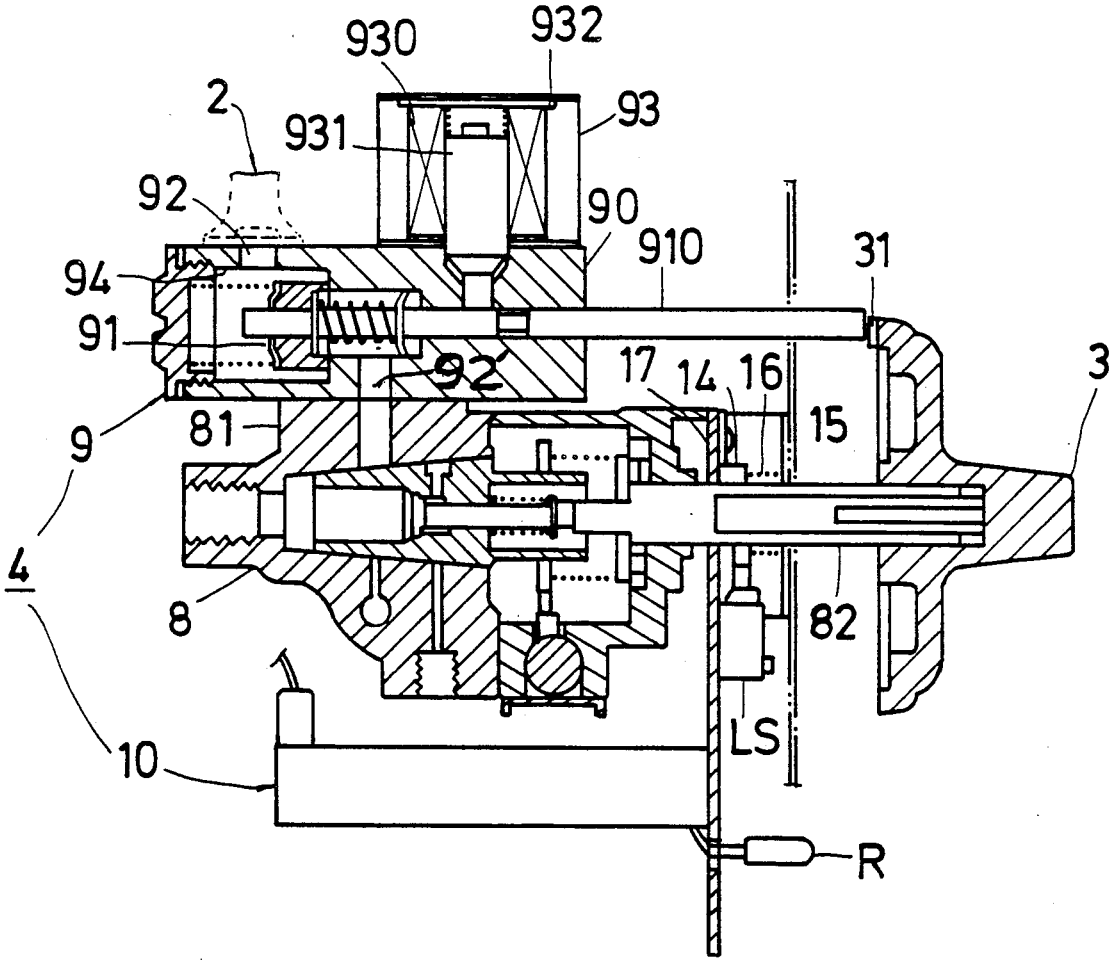
FIG. 4 is a vertical cross-sectional view of a gas safety valve device in combination with a traditional gas valve body device.
Figure 6:
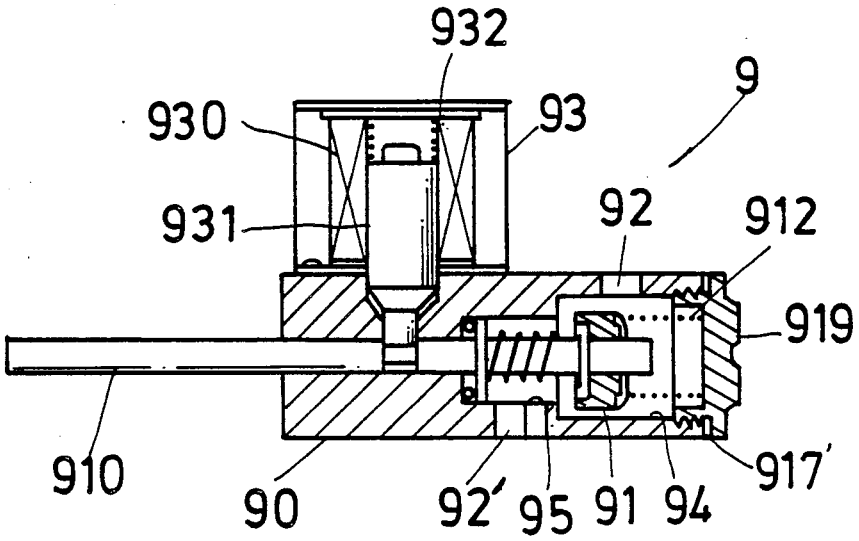
FIGS. 6 and 7 show respectively a vertical cross-sectional view of the gas safety valve device in an open and a shut condition.
Figure 7:
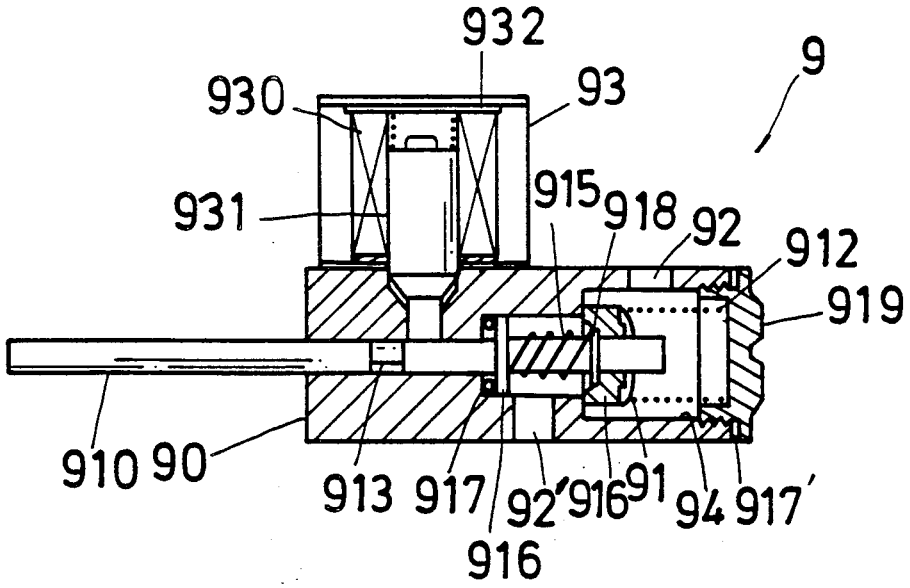
Figure 8:
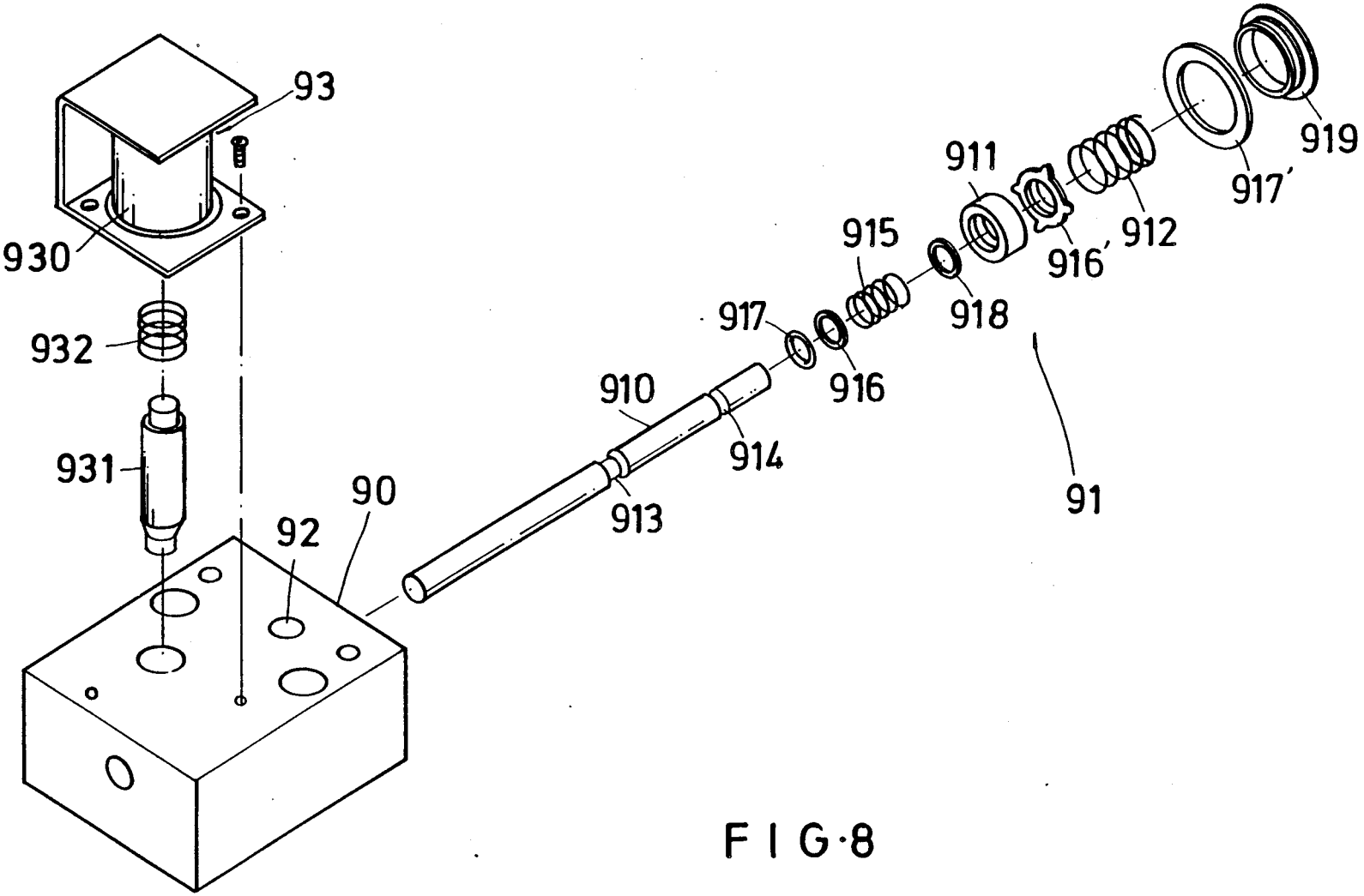
FIG. 8 is an exploded perspective view of the safety valve device of the present invention.

As shown in FIGS. 5, 7 and 8, the gas safety valve device 9 of the present invention has one gas intake valve device 91 on one base 90, one gas intake plenum 92 and one gas discharge plenum 92' (FIG. 7). Plenum 92 and 92' are also configured to connect respectively with gas intake pipe 2 and gas valve body 8 (as shown in FIGS. 4 and 5). Also on base 90 is an electromagnetic or solenoid valve 93. Gas intake valve device 91 (FIG. 8) comprises mainly a function shaft 910, a piston 911 and a piston spring 912 contained in a horizontal bore or level hole 94 in one end of base 90 (as shown in FIGS. 6, 7 and 8). Function shaft 910 includes a cylindrical slot or concave loop groove 913 engageable by a ferrous metal core or control rod 931 of power supply electromagnetic valve 93 and one cylindrical slot or concave loop groove 914 of buckled piston. The electromagnetic core of valve 93, as shown in FIGS. 6, 7 and 8, when energized, can attract control rod 931, to move it upwardly to disengage from slot 913 on the function shaft 910. When deenergized, and thus when the magnetic force disappears, the elasticity coming from the spring 932 drives control rod 931 downwardly to return to the original position.

In order to guard against the gas leakage from inside and outside of level hole, there is a seal comprised of a spring 915, one washer 916 and one leak-proof rubber O-ring or loop 917 on the function shaft 910 in the rear of piston 911. Thus O-ring 917 is resiliently seated to prevent gas leaking with the aid of spring 915 and the pressure of washer 916. Also, there is a plug cover 919 and a rubber washer 917 to seal the opening of bore 94. In between piston 911 and plug cover 919, there is a valve spring 912 and a washer 916' fitted to force piston 911 to shut off the gas intake valve 95.

The present invention comprises the above embodiments. Please refer to the aforesaid figures again to give detailed description of this invention.

When one presses by hand and rotates the gas stove's rotary knob 3 counterclockwise to start, the rotary knob shaft 82 will be driven to move the protruding or concave points of cam 14 (when the cam in concave groove shape is adopted) to disengaged from micro-activated switch LS. This permits switch LS to switch to the ON (starting) state and energizes circuit device 10 resulting in pilot lamp R on top glowing. At this time, pressing gas switch rotary knob 3 downwardly will cause the protruding point 31 on top to make function shaft 910 of gas safety valve device 9 to move forward, opening up the gas intake valve 95 (as shown in FIG. 6) to supply gas to stove burner 5 (as shown in FIG. 1) for burning.

Function shaft 910 is maintained in the forward position by electromagnetic control rod 931 in the gas safety valve device, which maintains the gas intake valve 95 in the open state so as to supply stove burner 5 continuously with the gas for burning. The operation of circuit device 10 may still function to energize electromagnetic coil 930 so as to move control rod 931 upwardly to disengage from slot 913 of said function shaft 910. This enables function shaft 910 to move axially to close gas intake valve 95 by means of the resiliency of valve spring 912 and piston 911 of washer 916' seats against valve 95 to stop the gas flow for burning to stove burner 5 through the safety valve control device. Therefore, the purpose of safety automatic shut-off will be achieved. As stated above, the activation of the safety valve control device occurs if the cooking time is too long, or the fire does not go out (the time when one forgets to shut off the gas stove) or the stove head 5 is not ignited at fixed time, and the gas intake valve 95 will automatically shut.

Figure 9:
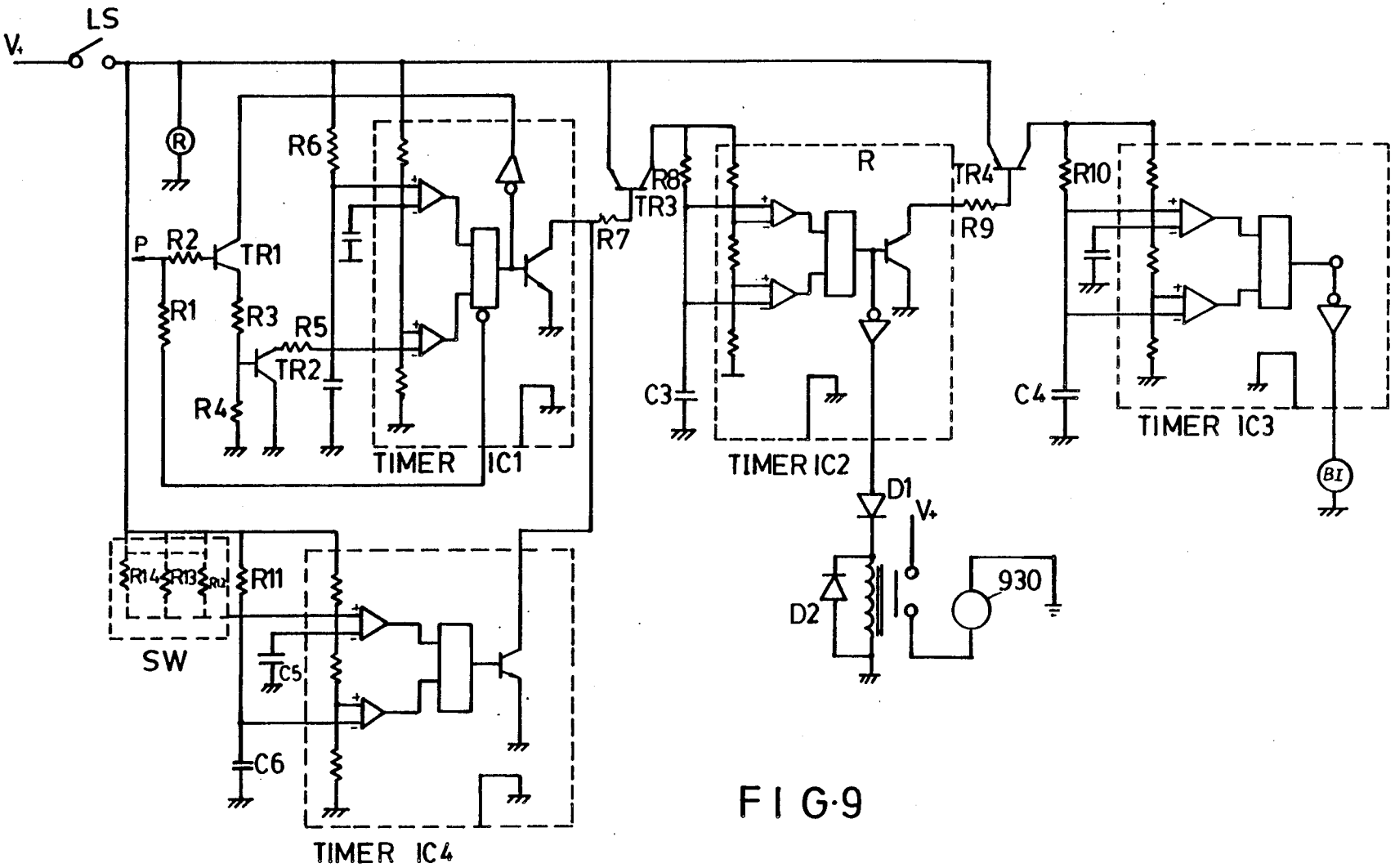
FIG. 9 is an electrical schematic circuit diagram of the control section of the present invention.

Referring now to the illustration of circuit device 10 as shown in FIG. 9, more detailed description of operation and function will be given as follows.

While using the gas stove, the operator presses the left-turned rotary switch knob 3 downwardly to turn on the gas safety valve and supply gas to the gas switch. This also activates the gas switch to produce a spark to ignite the gas supplied to the stove burner. At this moment, the micro-activated switch LS is switched, the pilot lamp R is on and the electronic circuit, and in particular, a timer IC1 is energized. When timer IC1 is energized, the high electric potential output end will have a high potential output to a transistor (TR1)(a PNP model). When the P point (namely, the spark detector fixed at the particular stove burner) is at a low potential due to the burning induction of the stove burner, then the base electrode of transistor TR1 is at a low potential, resulting in the high potential for supply to the base electrode of a transistor TR2 in making through the collector. Therefore, transistor TR2 is a NPN transistor model. When transistor TR2 conducts, the current goes through a resistor R5 from a resistor R6, and goes through the collector of transistor TR2 for transmission through the emitter. This short circuits a capacitor C1 and keeps it at a low potential with no way to charge. Thus timer IC1 can not be energized, making the output terminal of low potential inaccessible to ground. Thus, the gas stove will not suffer an automatic shut-off and a buzzing noise during the normal burning state.

At the same time a timer IC4 of safety memory device is also activated by switch LS's circuit for starting actions. The current will start charging a capacitor C6 from a resistor R11. When the capacity of the capacitor reaches two thirds of the power source's voltage (it can vary from about 10 minutes to over one hour in normal conditions), the TIMER IC4 activates and its collector output terminal is connected to ground for transmission. Thereby the base electrode of transistors TR3 and TR4 have a state of low potential. Due to this, the collectors of transistors TR3 and TR4 have a high potential which is transmitted to the input terminal's connecting legs at timer IC2 and timer IC3. Simultaneously, a high potential output is supplied to coil 930 of the safety electromagnetic valve and to a buzzer BI, automatically shutting off the gas stove and giving a warning noise. At the same time, the current will continuously recharge from resistors R8 and R10 for capacitors C3 and C4.

When the voltage of capacitors C3 and C4 reach about two thirds of the power source's voltage, the IC (TIMER IC2, TIMER IC3) turns off. Thus the high potential output terminals are eliminated and coil 930 of the electromagnetic valve of gas safety valve device and buzzer BI cease functioning. Under normal conditions, the time it takes timer IC2 to reach a high potential output is about 0.5 second (IC TIMER IC2 controls the coil 930 of electromagnetic valve of gas safety valve device 9). Only instantaneous excitation of coil 910 will shut-off gas intake valve 95. IC timer IC3 function time is from about ten seconds to a few minutes so as to give a buzzing warning, but the action will cease automatically at the given time limit.

After understanding the above normal functions, the conditions under which the fire dies out or the gas is not ignited promptly will ow be described. Once the fire on the gas stove has been extinguished (e.g., by a strong wind) or is extinguished by the spillage of water, or is not promptly lighted at stove burner 5, the spark detector 6 at the stove head will detect no flame. Then the P point will have a high potential. The base electrode of transistor TR1 has a potential existing, hence, the collector of transistor TR1 is cut, causing the base electrode of TR2 to become low potential. As transistor TR2 is an NPN model, so the collector and emitter are not completed to ground. Thus, the current begins to recharge from resistor R6 via capacitor C1, which together constitute the time constant, with the normal conditions being about 0.5 to about 2 seconds. When the capacitor C1 is recharged to two thirds of the power source's voltage, timer IC1 is turned off, making a low potential at the output terminal of the IC. Therefore, the base electrode of transistors TR3 and TR4 each have a low potential, so collectors of transistors TR3 and TR4 have a high potential output each to the input terminal connecting legs of timers IC2 and IC3. With the high potential at the input terminals of timers IC2 and IC3 each has a high potential output to energize coil 930 of electromagnetic valve 93 of intake valve device and buzzer BZ. Meanwhile, the current, through resistors R8 and R10, will cause capacitors C3 and C4 to recharge continuously to IC for turn-off and make the output terminals of timers IC2 and IC3 to cease functioning. When the time switch is operated, the rotary band switch will choose different resistors R12, R13 . . . . and so on to limit the input of the charging current, enabling capacitor C6 to reach the necessary activation voltage and thereby provide different time cycles. Thus the state-by-stage choice of time control will be achieved easily—that is the duration of gas stove use and cooking can be set at will.

Figure 10:
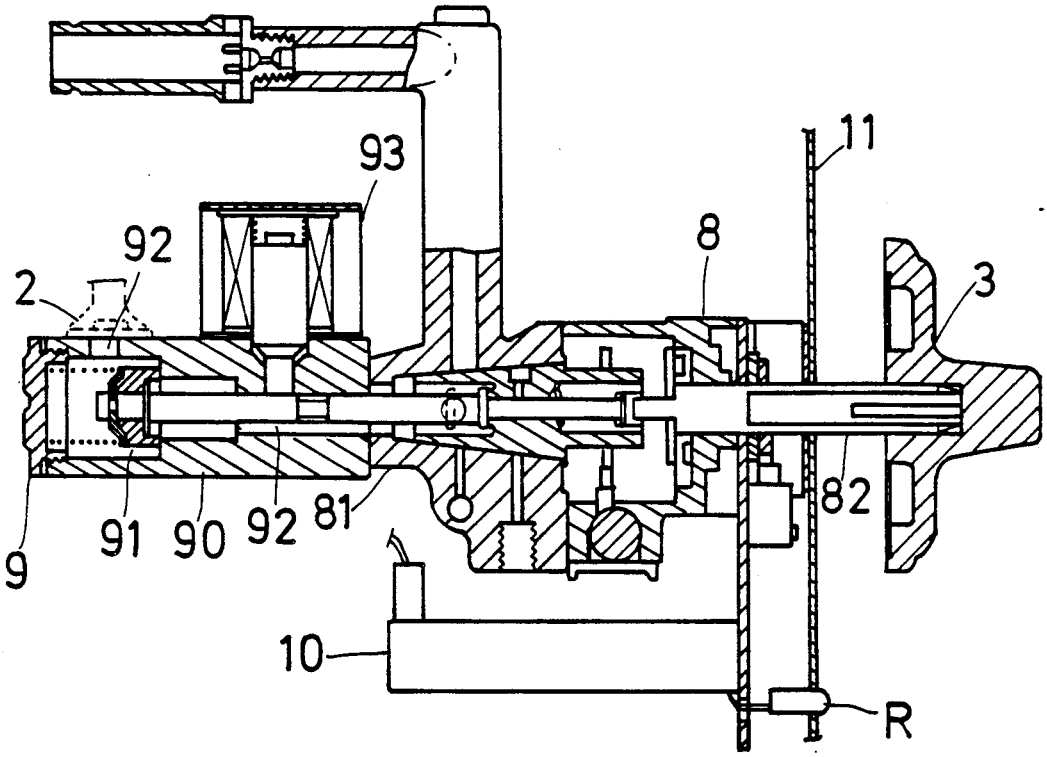
FIG. 10 is an elevational view, partly in cross-section showing the combination of the gas safety valve device and conventional gas (stove) valve body.

The embodiment mentioned previously has the gas intake pipe's catch base 81 located at the upper part at the side of gas valve body 8. If the catch base 81' of gas intake pipe is located at the back of gas (stove) valve body 8', then it is necessary to use the embodiment of the invention as shown in FIG. 10. The only thing to do is to keep gas hole 92' of gas safety valve device parallel to the function shaft 910, and place spring 915, washer 916 and leak-proof rubber ring 917 on it and attach directly the gas safety valve device on the catch base 81' of gas intake pipe in the rear of gas (stove) valve body 8'. The operation mode, the circuit device, its characteristics and effects are the same as those stated previously. It is unnecessary to go into any more details.

From the above description, we can know the following characteristics of this invention.

This invention is characterized by mating the timer IC with a resistance and capacitance to serve as "Time control device". When the gas rotary switch is turned on, the micro-switch will be actuated to make the time control device operational. After the time (ten more minutes or few hours) is set, the coil of safety valve device will be excited instantaneously with the aid of circuit operation to shut off the gas and initiate buzzing. This completes the action of automatic shut-off of the gas when one forgets to shut it off. Certainly, the IC and capacitance can use a band switch to set the different resistances or use an adjustable rheostat to attain the time control "Time switch" purpose.

Another characteristic of this invention is that this invention utilizes the flame to control the electricity to control the circuit, hence the action is very accurate; besides, employment of IC operation can delay the output signal for about few seconds to control the gas intake valve, thereby eliminating the gas fire glimmering or misled action caused by a floating fire. The safety automatic control device of this invention will be made more perfect.

Another strong point of this invention is that, in case the circuit system fails, the traditional hand-pressed gas switch can continuously be used for ignition, and the gas valve system may continue to be used because it has originally the hand-pressed rotary knob switch for start. Accordingly, even if the batteries are running low or the circuit is having trouble, one may follow the normal operation to use the stove without any difficulty.

It is thus seen that this invention is a gas stove having a safety automatic control device under the normal state; if the batteries are dead or a break-down happens, the traditional operation of the gas stove can be assured without suspending cooking. It is a stove having two purposes.

The present invention also features a design that is divided generally into three parts, namely, a traditional ignition system of the gas switch, a safety automatic control valve device and an electronically controlled device, so the maintenance is quite easy because of the ease of assembly and disassembly. Even the general dealers undertaking gas business can do the maintenance with little instructions.

I claim:

1. An automatic shut-off safety device for a gas stove that has a gas intake pipe connected to a manifold of a gas valve and a control knob for operating the gas valve, the safety device comprising a gas safety valve device located between the stove intake pipe and the stove gas valve manifold, the gas safety valve device comprising a housing base having an intake orifice connectable to the stove gas intake pipe and an exhaust orifice connectable to the stove gas valve manifold, an intake valve device comprising a function shaft having a first groove therein and being axially positionable by the stove control knob, a piston mounted on said function shaft and configured so as to be able to prevent the flow of gas between said housing intake and exhaust orifices when said function shaft is in a first axial position and to permit the gas flow when said function shaft is in a second axial position, a piston spring means for urging said piston in a first axial direction toward said first axial position, an electromagnet actuator mounted on said base and comprising an electromagnet coil, a magnetizable control rod extending in a radial direction with respect to said function shaft for engagement with said function shaft groove to prevent the withdrawal of said function shaft when so engaged, said control rod being positionable by said coil to disengage from said function shaft groove when said coil is energized, and a spring for resiliently urging said control rod in a position to engage said function shaft; and an electronic circuit comprising switch means controllable by the stove gas valve for supplying power to said circuit when the stove gas valve is operated, means for sensing the operation of the stove's gas fire when burning and providing a signal to actuate said electromagnetic actuator when said fire is out;

and timing means to send a signal to actuate said electromagnetic actuator when a predetermined time has expired.

* * * * *